United States Patent [19]

Wyckoff

[11] Patent Number: 4,651,652

[45] Date of Patent: Mar. 24, 1987

[54] VERTICALLY ADJUSTABLE WORK DESK

[75] Inventor: Robert R. Wyckoff, Aurora, Ill.

[73] Assignee: AT&T Bell Laboratories, Murray Hill, N.J.

[21] Appl. No.: 684,147

[22] Filed: Dec. 20, 1984

[51] Int. Cl.[4] ..... A47B 9/00

[52] U.S. Cl. ..... 108/144; 254/386; 108/147

[58] Field of Search ..... 297/144, 147, 136; 5/63; 254/386

[56] References Cited

U.S. PATENT DOCUMENTS

| | | | |
|---|---|---|---|
| 2,306,266 | 12/1942 | Heim | 108/147 |
| 2,683,882 | 7/1954 | Smith | 254/386 X |
| 3,415,586 | 12/1968 | Hammond | 108/147 X |
| 3,444,830 | 5/1969 | Doetsch | 108/136 |
| 3,820,176 | 6/1974 | Feiertag | 108/147 |
| 3,825,244 | 7/1974 | Bauer | 267/124 |
| 3,865,066 | 2/1975 | White et al. | 254/386 X |
| 3,880,096 | 4/1975 | Kaplan | 108/141 |
| 3,998,432 | 12/1976 | Uldricks et al. | 254/386 |
| 4,057,240 | 11/1977 | Damico et al. | 269/325 |
| 4,315,466 | 2/1982 | Boerigter | 108/147 |
| 4,351,245 | 9/1982 | LaPorte | 108/136 |
| 4,381,714 | 5/1983 | Henneberg et al. | 108/147 |
| 4,428,631 | 1/1984 | Cope et al. | 312/194 |
| 4,516,478 | 5/1985 | Connelly | 254/386 X |

FOREIGN PATENT DOCUMENTS

| | | | |
|---|---|---|---|
| 515132 | 11/1952 | Belgium | 108/147 |
| 1429534 | 1/1969 | Fed. Rep. of Germany | 108/147 |

OTHER PUBLICATIONS

Mutoh Industries Ltd., Sales Brochure for Drafting Stand TG-100.

*Primary Examiner*—Peter A. Aschenbrenner
*Attorney, Agent, or Firm*—Werner Ulrich; Peter Visserman

[57] ABSTRACT

A work desk has an adjustable height working surface that is raised by a force applied by a lockable gas spring via a first pulley system. The first pulley system doubles the travel of the working surface as compared with the travel of the piston of the gas spring. A second pulley system ensures that all parts of the working surface are raised by an equal amount. Four slides guide the movement of the working surface. The combination of the slides and second pulley system allows the working surface to be closely held with a minimum of lateral or vertical play when the gas spring is locked. The first pulley system, in conjunction with a commercially available gas spring, the travel of whose piston is limited to 7½ inches (190 mm), permits a vertical travel of 15 inches (380 mm) for the working surface. This travel is adequate to permit a broad range of operators to use the work desk while working in either a sitting or a standing position.

9 Claims, 7 Drawing Figures

VERTICALLY ADJUSTABLE WORK DESK

TECHNICAL FIELD

This invention relates to work desks and, more specifically, to work desks having a vertically adjustable work surface.

BACKGROUND OF THE INVENTION

The need for vertical adjustment of a work surface for a work desk such as a drafting table, operating table, work bench, or support for a computer terminal has long been recognized. Both the productivity and the comfort level of the individuals using the work desk are increased if the height of the work or support surface can be adjusted to fit the needs of a particular individual. Elaborate arrangements for such height adjustments have long been prevalent in such diverse areas as operating tables and drafting tables. In most cases, however, the adjustment has either been for a relatively small vertical travel or for adjustment to one of two distinct vertical positions, or has been elaborate and costly. The adjustments normally provided are frequently considered inadequate by users. For example, according to a recent report in Business Week (Nov. 5, 1984, p. 66), 70% of personal computer users surveyed complained about the lack of flexibility of their computer terminal desks.

It has been found that for some kinds of jobs the ability to switch between the standing and sitting position acts to relieve fatigue and therefore to improve productivity. If a work desk is to be used in either the standing or the sitting position, it is necessary to make a substantial vertical adjustment of the height of the work surface and desirable to have a nearly continuous vertical adjustment to provide the optimum surface height for short and tall operators. To meet this need, a work desk capable of continuous adjustment of the height of the work surface of about 15 inches with minimum adjustment effort and cost is needed. Gas spring actuated arrangements have been described for raising and lowering the height of the work surface of an operating table, but the height adjustment is limited to about eight inches, the travel of the movable part of a gas spring.

A further problem encountered in work desks with vertically adjustable work surfaces is that of achieving vertical motion without encountering a tendency to jam, while at the same time providing minimum play side support for the work surface. If the side supports are too tight, there will be a tendency for the work surface to jam when adjusted. If the side supports are not tight enough, there will be excessive play in the position of the work surface when it has been adjusted to the desired height.

SUMMARY OF THE INVENTION

In accordance with the present invention, a lockable gas spring supplies a driving force to raise the working surface of a work desk, and a pulley arrangement multiplies the maximum travel of the gas spring to achieve vertical travel of the work surface over a large range. When the gas spring is unlocked, it exerts a force to overcome the weight of the movable working surface assembly and its contents and raises the working surface. However, only a small force is necessary to counter the difference between the upward force exerted by the gas spring via the pulley arrangement and the weight of the movable assembly and contents. The operator can either push down or pull up the working surface when the gas spring is released using only a small force or can let the surface rise from the force exerted by the gas spring and stop the rise at his/her convenience. Once the working surface is at the appropriate height, the gas spring can be locked and will thereafter exert a very strong force to maintain the height of the working surface.

In accordance with another aspect of my invention, the work surface assembly and a base assembly are connected by two or more vertical slides, each slide having one member attached to each of the assemblies, and a dual pulley system; cables for each of the pulley systems are attached to the movable assembly, and the pulleys are attached to the base assembly, cables for each of the pulley systems being attached to the movable assembly at two points. The center of gravity of the work surface assembly is substantially inside an imaginary prism formed by the planes connecting adjacent vertical lines emanating from the connection points between each of the two pulley systems and the work surface assembly. Advantageously, in such an arrangement, the vertical slides may be mounted to guide the movable assembly closely without risk of jamming due to an unequal change of vertical position of the two sides or of the front and back of the work surface assembly. Further, the work surface assembly moves very easily and smoothly.

Commercially available gas springs are limited to a travel of about eight inches. In accordance with one specific embodiment of the invention, a first dual pulley system is used for multiplying the travel of the gas spring by two. In this specific embodiment, a gas spring is centrally mounted and the first dual pulley system for raising or lowering a work surface assembly is symmetrically located about a vertical front-to-back center plane of the work desk. The first dual pulley system is attached to the back portion of the work surface assembly. A second dual pulley system is tied to the movement of the work surface assembly caused by the first pulley system. The second pulley system is used to match the vertical movement of the sides and front of the two sides with the vertical movement of the center and back of the work surface assembly. This sharply reduces the tendency to jam the work surface assembly against the sides and corners of the base assembly. In this specific embodiment of the invention, the base assembly includes the fixed parts of four vertical slides. One moving part of each of the vertical slides is attached to the work surface assembly, so that the work surface assembly slides within the four vertical slides as it is raised or lowered. The work surface assembly is lifted evenly by cables from the second pulley system attached near the two front slides, and by cables from the first pulley system attached near the rear center. Advantageously, such an arrangement provides a low cost but sturdy work desk whose work surface moves up and down smoothly without jamming and is held firmly in place when the gas spring is locked.

In accordance with a second embodiment of the invention, the first pulley system is designed to multiply the travel of the gas spring by three in order to achieve a total vertical adjustment in excess of twenty inches. Advantageously, such an arrangement allows a still greater vertical adjustment at the cost of a more powerful gas spring and a small increase in the cost of the first pulley system; the second pulley system and slides are unaffected.

BRIEF DESCRIPTION OF THE DRAWING

The organization and operation of a vertically adjustable work desk designed according to this invention will be better understood from a consideration of the detailed description in conjunction with the accompanying drawing in which.

DETAILED DESCRIPTION

A vertically adjustable work desk designed according to this invention comprises a work surface assembly mounted to a base assembly by a set of four vertically oriented ball bearing slides. A lockable gas spring mounted at the rear of the work desk provides the upward force to support and raise the work surface assembly and an associated pulley system mechanically doubles the distance the working surface can be raised. In addition to the support provided by the gas spring and pulley system at the center rear of the work desk, a second pulley system provides support near the front end of the two sides of the work surface assembly.

Figure 1:
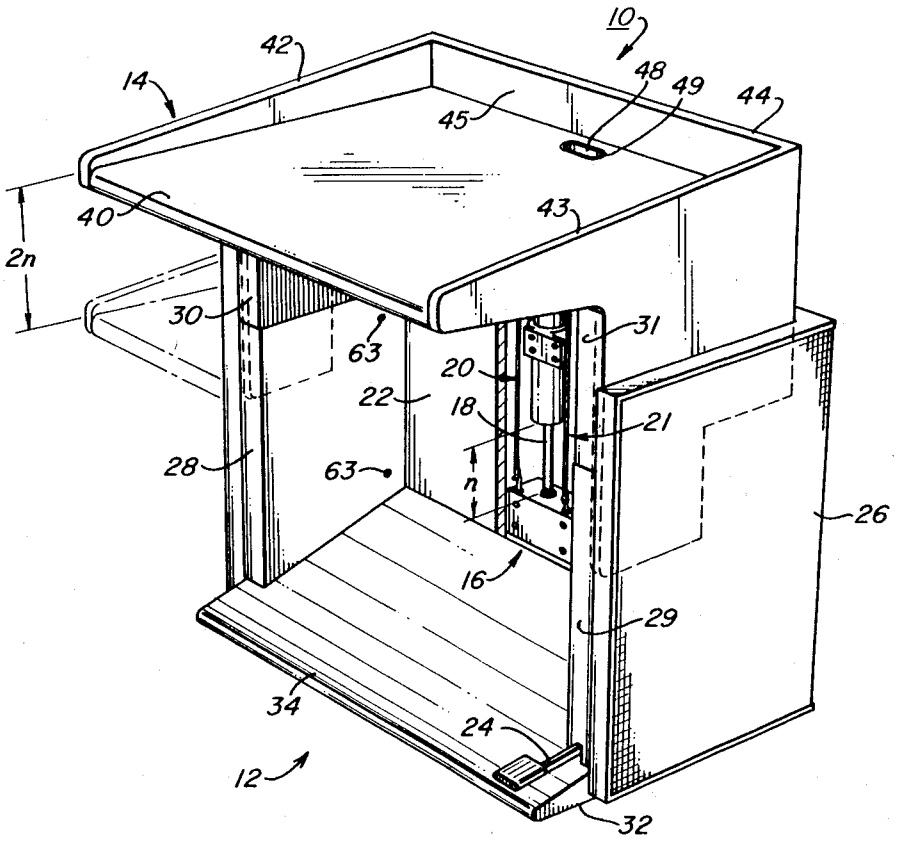
FIG. 1 is a perspective view of the vertically adjustable work desk showing an expanded gas spring and a proportionately (2:1) raised working surface.

FIG. 1 illustrates a vertically adjustable work desk 10 in which a gas spring operated mechanism 16 is located between a floor supported base assembly 12 and a movable work surface assembly 14. The gas spring operated mechanism 16 is used to raise, lower and support the weight of work surface assembly 14 and its normal contents. The gas spring operated mechanism 16 is located behind a rear wall 22 of the base assembly 12 and consists of a lockable gas spring 18 and pulley systems 20 and 21. The gas spring 18 provides the driving force required to raise the work surface assembly 14 and its contents while the pulley systems 20 and 21 provide a mechanical advantage of 2:1. Thus, in order to raise the work surface assembly 14 a distance of 2n inches, the gas spring 18 need only expand n inches. In one exemplary embodiment of the invention a work desk utilizes a gas spring capable of extending 7.5 inches, allowing the height of the work surface assembly 14 to be raised 15 inches so that a user may sit or stand at the work desk.

The gas spring is controlled by a spring loaded, foot operated lever 24 mounted at the right side of base assembly 12 which can be operated from the seated or standing position. Pressing the lever 24 downward unlocks the gas spring 18 thus allowing the work surface assembly 14 to be raised or lowered. Releasing the lever 24 to its original position locks the gas spring 18 which then rigidly supports the work surface assembly 14 at its newly adjusted height.

The base assembly 12 and the work surface assembly 14 may be constructed according to generally accepted furniture building techniques using any rigid construction material such as particle board or plywood. A decorative skirt 26 rests on a base flange and is held in place by a series of pins. Skirt 26 has no structural importance and can easily be lifted away to gain access to the gas spring operated mechanism 16. A pair of inner shields 28 and 29 and a set of covers 30 and 31 are used to protect a work desk user's legs from the guide and support systems at the sides of the work desk 10. The shields 28 and 29 and covers 30 and 31 are held in place by fasteners 63 and can also be easily removed to gain access to the guide and support mechanism. A set of leveling feet may be provided as desired in order to compensate for uneven floor conditions.

The structure of the base assembly 12 includes a platform 32, the rear wall 22 extending upward therefrom and an inclined foot rest 34 extending backward to rear wall 22. The rear wall 22 serves both as a rigid mounting surface for the gas spring operated mechanism 16 and as a barrier between a work desk user's feet and that mechanism.

The work surface assembly 14 includes a working surface 40 which is joined to side walls 42 and 43 and rear wall 44. The side walls 42 and 43 and rear wall 44 extend upward to form a low retainer 45 for working surface 40 and extend downward into base assembly 12 to provide the mounting surfaces for attaching pulley systems 20 and 21. A slot 48 is provided at the rear of working surface 40 to allow cabling access from the back of the base assembly 12. A grommet 49 protects the cabling from the abrasiveness of the material used in constructing the working surface 40.

Figure 2:
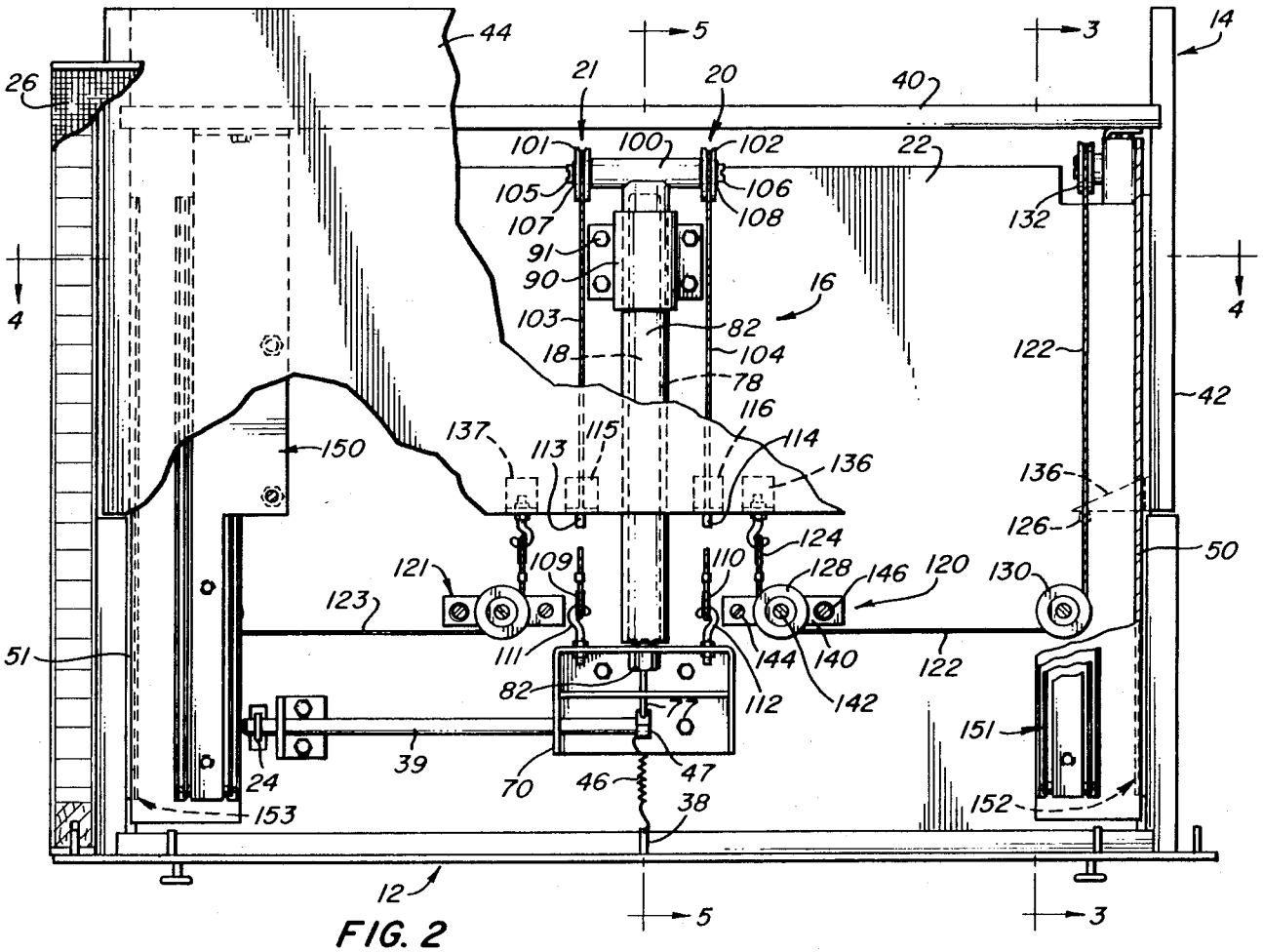
FIG. 2 is a rear view of the work desk in its lowest position.

FIG. 2 illustrates the arrangement of the centrally located gas spring operated mechanism 16, the symmetrical pulley systems 20 and 21 on each side of the gas spring mechanism 16, the symmetrical support pulley systems 120 and 121 located at the left and right sides of the base assembly 12, and two pairs of slides 150, 151 and 152, 153 mounted between base assembly 12 and work surface assembly 14. The symmetry of the pulley systems 20 and 21 and 120 and 121 and slides 150–153 about the centrally located gas spring 18 insures that each side of the work surface assembly 14 will rise or descend the same distance at the same time. Thus, the slides 150–153 will guide movement of the work surface assembly 14 without being jammed due to an unequal vertical position of different portions of the work surface assembly.

Figure 3:
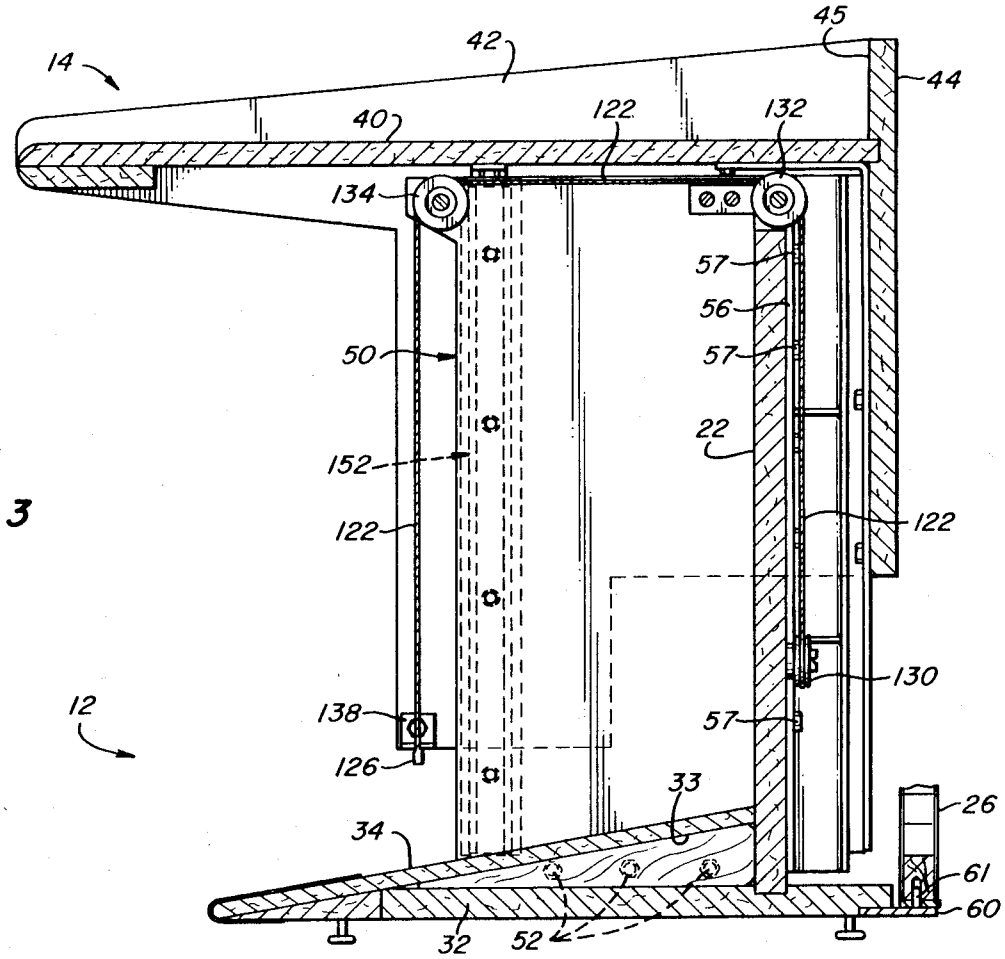
FIG. 3 is a sectional end view of the work desk from the inside as seen through a plane designated 3—3 in FIG. 2.

The base assembly 12 includes a pair of steel vertical mounting brackets 50 and 51. Rear wall 22 is supported in a vertical plane by the mounting brackets 50 and 51 which project upward from the left and right side of base assembly 12. As better seen in FIG. 3 one of the mounting brackets 50 is fastened to the left side of base assembly 12 by fasteners 52 which engage a triangular glue block 35 which has been installed in a cavity 33 formed by rear wall 22, platform 32 and foot rest 34. The mounting bracket 50 is fastened to the left side of rear wall 22 by mounting plate 56 and fasteners 57. The other mounting bracket 51 is installed in the right side of base assembly 12 in a similar manner thus providing a very stiff rear wall 22 upon which the gas spring operated mechanism 16 is mounted.

Figure 4:
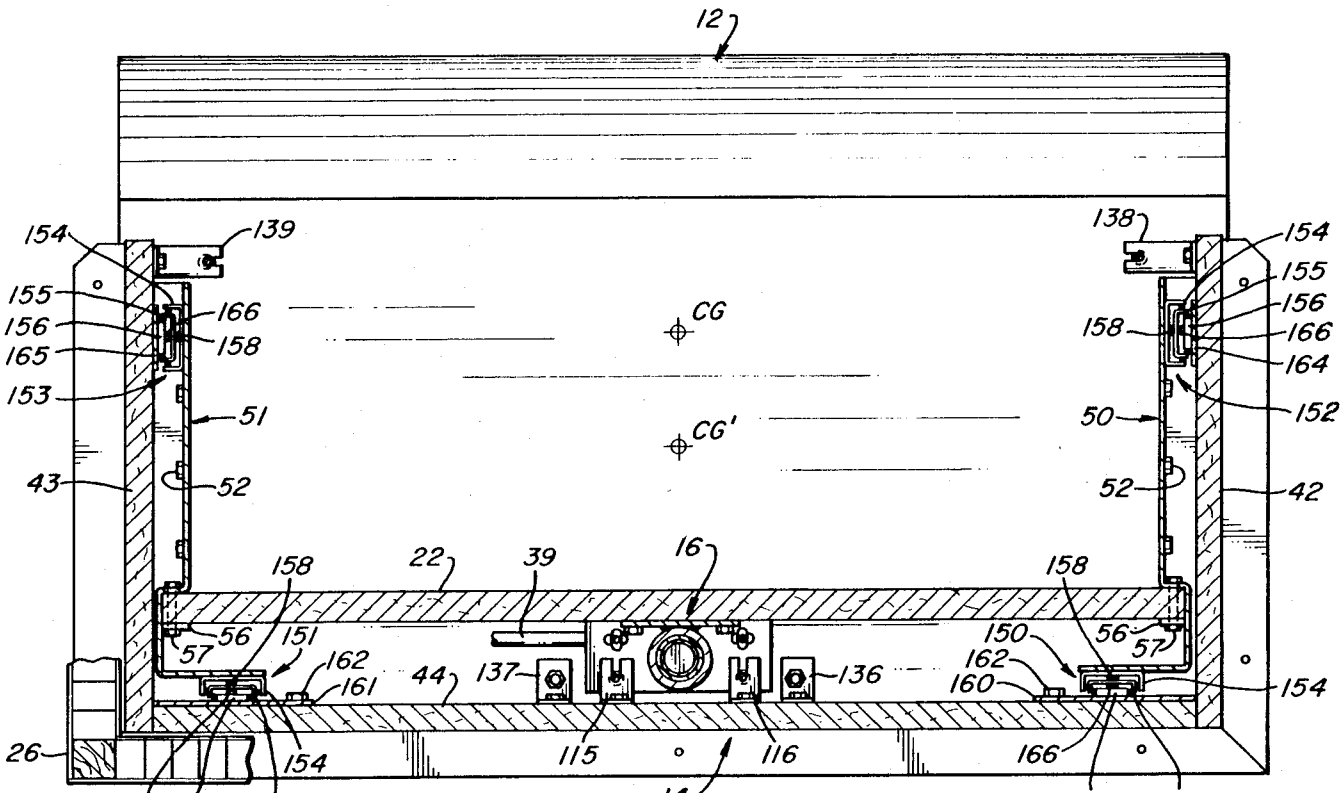
FIG. 4 is a top sectional view of the work desk as seen through a plane designated 4—4 in FIG. 2.

The work surface assembly 14 is slidably attached to base assembly 12 by four commercially available ball bearing slide assemblies 150–153. As shown in FIG. 4, one pair of slide assemblies 150 and 151 is mounted at the back corners of work desk 10 between mounting brackets 50 and 51 of base assembly 12 and rear wall 44 of work surface assembly 14. The second pair of slide assemblies 152 and 153 is mounted at the sides of work desk 10 between mounting plates 50 and 51 of base assembly 12 and side walls 42 and 43 respectively of work surface assembly 14. The side mounted pair of slide assemblies 152 and 153 is in line with the center of gravity CG of the work surface assembly 14. The location of the center of gravity CG can be readily determined before the work surface assembly 14 is mounted in base assembly 12. When a computer terminal is placed in its proper position at the rear of the work surface assembly 14 the center of gravity CG′ of the terminal and work surface assembly 14 combined lies within an imaginary prism formed by indefinitely long vertical planes connecting center lines through each of the adjacent slide assemblies 150–153, which helps to minimize any residual lateral forces on the slides. The ball bearing slide assemblies 150–153 provide for the up and down vertical displacement of work surface assembly 14 without jamming and without any discernible rotative or lateral play after the gas spring is locked. In one exemplary embodiment of the invention utilizing four commercially available ball bearing slides a clearance of only one-eighth of an inch is needed between the movable work surface assembly and the outer skirt of the base assembly.

Each of the ball bearing slide assemblies 150–153 comprise a fixed member 154, an intermediate moving member 155 and an end movable member 156. The fixed members 154 are attached to the mounting brackets 50 and 51 with fasteners 158. The movable members 156 of slide assemblies 150 and 151 are attached to brackets 160 and 161 respectively with fasteners 166; the brackets in turn are attached to rear wall 44 of the work surface assembly 14 with fasteners 162. The movable members 156 of slide assemblies 152 and 153 are attached to brackets 164 and 165 respectively with fasteners 166 which are in turn attached to side walls 42 and 43 respectively of the work surface assembly 14. As the work surface assembly 14 is raised the end members 156 slide upward the first half of the maximum distance of rise and the intermediate members 155 slide upward the last half of the distance.

Figure 5:
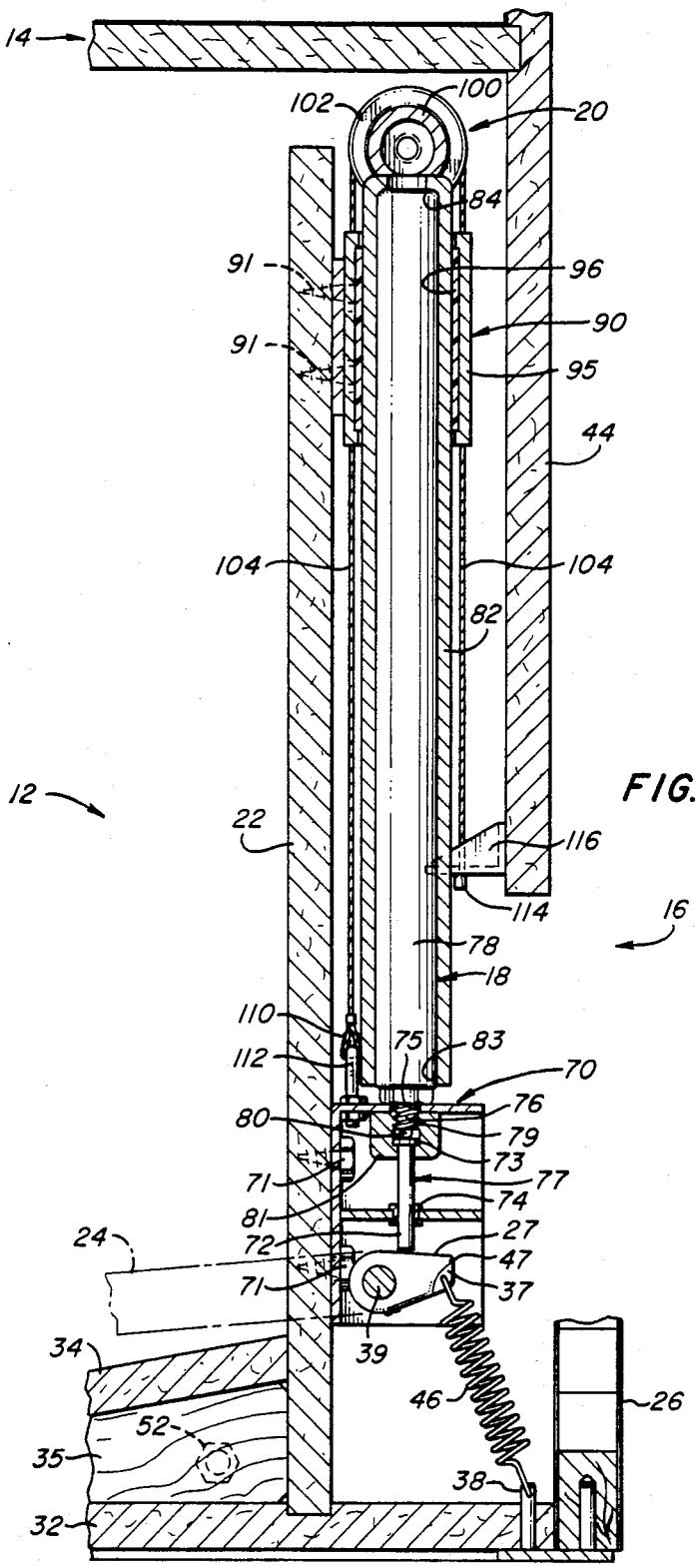
FIG. 5 is a partial sectional view of the gas spring operated mechanism as seen through a plane designated 5—5 in FIG. 2.

Referring now to FIG. 5, the gas spring operated mechanism 16 will be discussed in greater detail. The gas spring operated mechanism 16 consists of gas spring 18 mounted on base assembly 12 and pulley systems 20 and 21 attached between base assembly 12 and work surface assembly 14. In alternative embodiments, the gas spring 18 could be mounted directly on the floor instead of being connected to the base assembly 12.

Gas spring 18 comprise an outer tube 78 and piston rod 79. The outer tube 78 is filled with a compressed gas that exerts a force on piston rod 79 which emerges from the bottom end of gas spring 18 when unlocked. An operating pin 80 extends through the piston rod 79 and when depressed opens a valve which allows the compressed gas in the spring to exert its force on piston rod 79. A support bracket 70 used to mount gas spring 18 is fastened on the backside of rear wall 22 by fasteners 71. A threaded end 76 of the piston rod 79 extends through a hole 75 in bracket 70 and is securely fastened by a guide nut 81. The outer tube 78 is inserted into an open end 83 of a protective sleeve 82. As the gas spring 18 is operated, its force is imparted to a flanged end 84 of sleeve 82 so that the sleeve 82 moves up or down with the gas spring 18. A bearing assembly 90, mounted on the backside of rear wall 22 by fasteners 91 keeps the sleeve 82 and gas spring 18 on a true vertical axis so that no undue strain is put on either the outer tube 78 or piston rod 79. The bearing assembly 90 consists of a tubular body 95 with a nylon bushing 95 implanted within the inner diameter of the body. The bearing assembly 90 and local lubrication of the sleeve 82 provide for a very smooth, non-binding operation of the gas spring operated mechanism 16.

As previously mentioned, depression of the foot lever 24 unlocks gas spring 18. The foot lever 24 is attached to a connecting rod 39 that rotates a cam 47 upward when lever 24 is depressed. The cam 47 is contained within bracket 70 and has a surface 27 located just below a guide pin 77. The guide pin 77 has a shaft end 72 that is held in bracket 70 by a nylon snap-in bushing 74 and has a head 73 that is captured by guide nut 81. The guide nut 81 is adjusted to make sure that operating pin 80 is not activated when the foot lever is in its normal position. An expansion spring 46, hooked to an ear 37 on cam 47 at one end and to a pin 38 in platform 32 at the other end, maintains the cam 47 in its unoperated position to insure that the gas spring 18 is not accidentally operated.

Pulley systems 20 and 21, as better seen in FIG. 2, consist of a crosspiece 100, pulleys 101 and 102, and cables 103 and 104. The crosspiece 100 is welded atop sleeve 82 which, it should be recalled, moves up and down with gas spring 18. The pair of pulleys 101 and 102 are rotatably fastened, one at each end of crosspiece 100, with a shoulder screw 105 or 106 and a washer 107 or 108. Cables 103 and 104 are elongated, resilient, flexible braided wire of stainless steel with a low expansibility when under stress. The low expansibility of cables 103 and 104 prevents a jerky or uneven movement of work surface assembly 14, and prevents jamming in case uneven forces are exerted on the work surface. Cable 103 has an eye end 109 and a lug end 113. Cable 103 is caught at eye end 109 by a hook 111 fastened to bracket 70, passes upwardly, is trained around pulley 101 and passes downwardly where lug end 113 is attached to a mounting tab 115 on the work surface assembly 14. Cable 104 similarly has an eye end 110 caught by a hook 112 fastened to bracket 70, is trained around pulley 102 and has a lug end 114 fastened to a mounting tab 116 on the working surface assembly 14.

Figure 6:
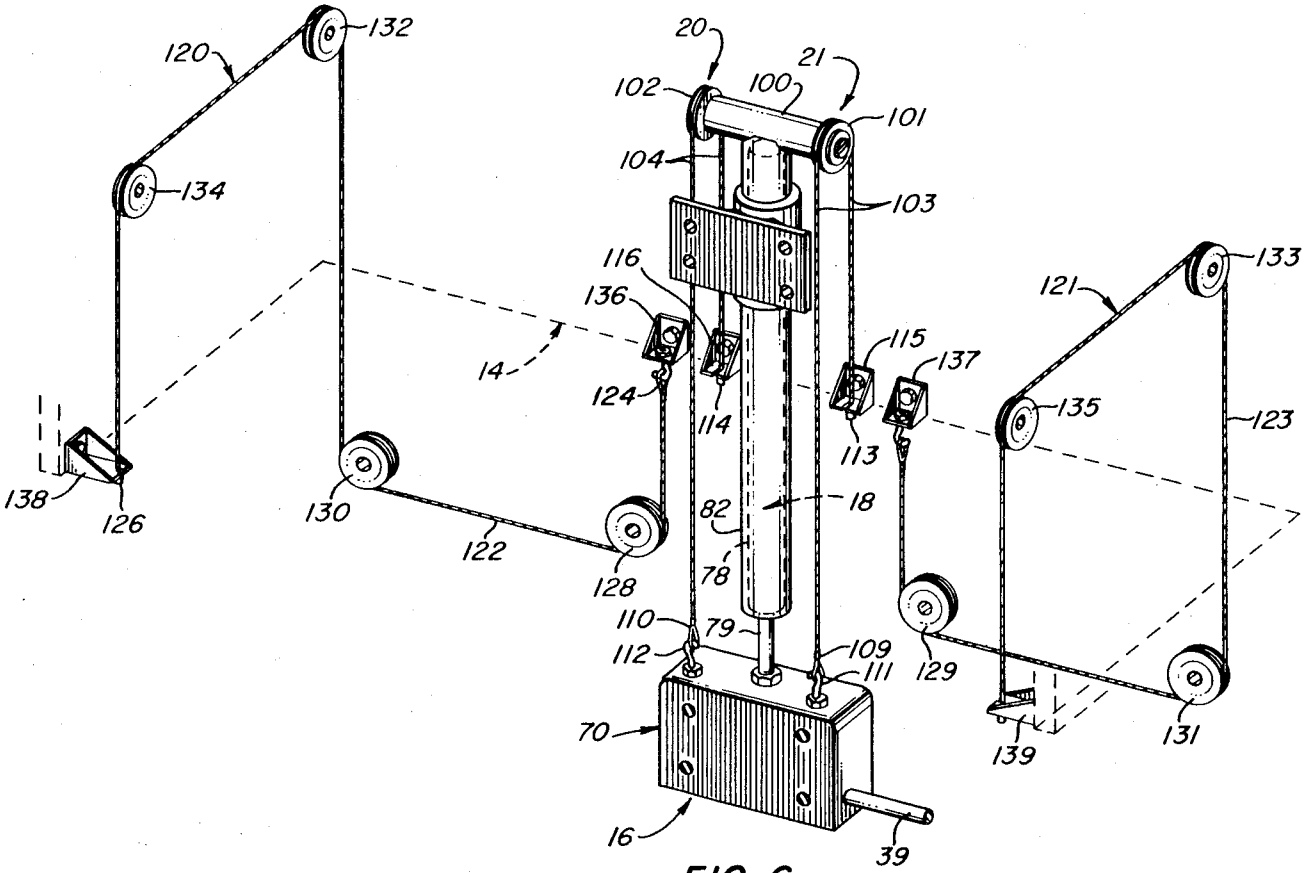
FIG. 6 is a schematic diagram of the complete gas spring operated mechanism and cable support arrangement.

Referring again to FIG. 5, the operation of the gas spring operated mechanism 16 will be described. If a work desk user decides to raise the work surface assembly he or she depresses the foot operated lever 24 which, through connecting rod 39, rotates cam 47 counterclockwise The top surface 27 of cam 47 impinges on the shaft end 72 of guide pin 77 and forces the head 73 to depress valve pin 80, unlocking the gas spring 18. The unlocked gas spring 18 exerts an upward force on protective sleeve 82, and consequently crosspiece 100 with pulleys 101 and 102 attached. Only pulley system 20 is shown in FIG. 5 but the reader will find it advantageous to refer also to FIG. 6 to understand that pulley system 21 operates in a like manner and simultaneously. As the pulley 102 rises, cable 104 which is secured to the base assembly 12 at its eye end 110, exerts a lifting force at its lug end 114 which raises the work surface assembly 14. Since the mechanical advantage of a pulley system is equal to the number of strands supporting the system, the mechanical advantage of the pulley system 20 is 2:1. However, because the pulley system 20 doubles the distance the work surface assembly 14 moves, it does so at the expense of the amount of force needed to be applied by the gas spring 18. Thus, the gas spring 18 must have at least a force, when fully extended, equal to twice the height of the work surface assembly 14 and its normal contents. In one exemplary embodiment of the invention a work desk utilizes a commercially available gas spring having a compressed force of 1111 newtons or 249 pounds and an extended force of 835 newtons or 187 pounds, which, at a 2:1 advantage of its pulley system compensates for a total work surface assembly and computer terminal weight of about 90 pounds. Different size gas springs would be used for different combinations of weight of the movable work surface and its contents.

Ideally then, as in the above exemplary embodiment of the invention, the force transmitted by the gas spring operated mechanism is several pounds more than the weight of the work surface assembly 14 and its contents so that when gas spring 18 is unlocked the work surface assembly 14 will slowly rise. The user can aid in raising the work surface assembly 14 or apply a small downward force to lower the work surface assembly 14. The downward force is approximately 5 pounds when the work surface assembly is near its upper limit, and is greater when the work surface assembly is at an intermediate position, increasing to about 40 pounds when the work surface assembly is near its lower limit. When the work surface assembly 14 is in its desired position the user releases foot operated lever 24 which releases valve pin 80, again locking gas spring 18.

In alternative embodiments, the weight of the work surface assembly 14 and its contents could slightly exceed the force transmitted by gas spring 18 although this is not desirable. The operator would then have to apply a lifting force in order to raise the work surface assembly 14.

While the pulley systems 20 and 21 lift and support the work surface assembly 14 at two points near the center of back wall 44, a second set of pulley systems 120 and 121, shown on FIG. 2, lift and support the work surface assembly at points near the front edges of side walls 42 and 43. These lifting points can be seen in FIG. 4 and FIG. 6 as the location of the four lifting tabs 115, 116, 138 and 139. The center of gravity CG of the work surface assembly 14 lies within an imaginary prism formed by indefinitely long vertical planes connecting the vertical projections of each of the adjacent lifting tabs 115, 116, 138 and 139, which eliminates the bulk of any lateral forces that may be applied by the work surface assembly 14 to the slides. Pulley system 120, shown in FIG. 2 and FIG. 3, consists of a cable 122 and a set of direction change pulleys 128, 130, 132 and 134. Pulley 128 is rotatably attached to an adjustable plate 140 by a shoulder screw 142. The plate 140 is attached to rear wall 44 by a pair of fasteners 144 and 146 which may be loosened and then retightened to adjust the position of pulley 128 in order to change the tension on cable 122. Pulley 130 is also rotatably attached to rear wall 22 and pulleys 132 and 134 are likewise rotatably attached to mounting bracket 50.

Cable 122 is an elongated, resilient, flexible, braided wire of stainless steel having a low expansibility with an eye end 124 and a lug end 126. As can best be seen in FIG. 6 the cable 122 is attached at its eye end 124 to tab 136, is trained under pulley 128, under pulley 130, over pulley 132, over pulley 134 and attached at lug end 126 to lift tab 138. Since pulleys 128, 130, 132 and 134 are attached to the base assembly 12 and the lift tabs 136 and 138 are attached to the movable work surface assembly 14 it can be seen that as the gas spring operated mechanism 16 lifts the work surface assembly 14, tab 136 rises and pulls on cable 122 at eye end 124, thereby retracting cable 122 and lifting the work surface assembly 14 at lift tab 138.

The pulley system 121, consisting of a cable 123 and a set of direction change pulleys 129, 131, 133 and 135, likewise transfers a lifting force from tab 137 to lift tab 139. Thus, the work surface assembly 14 is lifted and supported not only by the gas spring operated mechanism 16 at the center rear but also by pulley system 120 at the left side and pulley system 121 at the right side of work desk 10. The additional lifting points provided by pulley systems 120 and 121 serve also to relieve lateral strain on the slide assemblies 150–153, which gives the work surface assembly 14 a floating "feeling" when it is being raised or lowered. The low expansibility of the cables 122 and 123 minimize the tilt of the work surface assembly 14 when an operator leans on the edge of the working surface 40.

In one exemplary embodiment of the invention, a work desk utilizing four ball bearing slides and a dual cable support has a work surface which does not deviate more than one sixty-fourth of an inch from horizontal when pressure is put on the front edge of the desk top to lower it.

Figure 7:
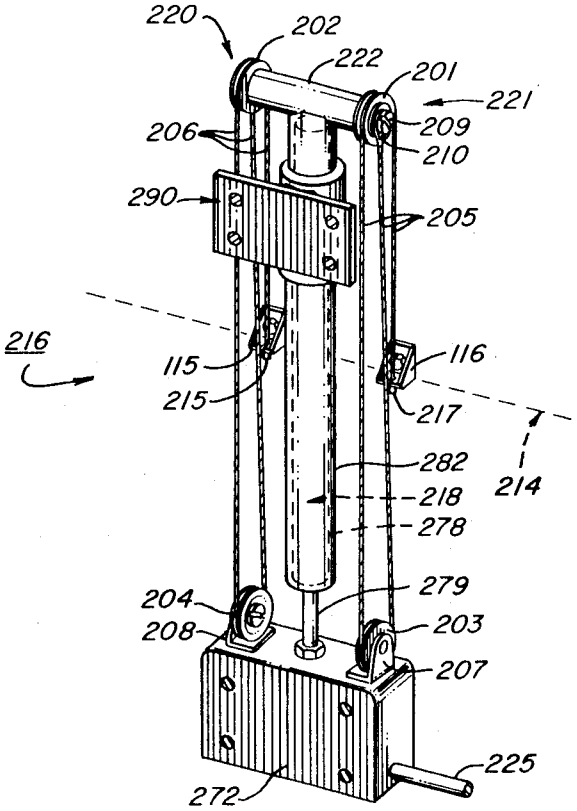
FIG. 7 is a perspective view of a gas spring operated mechanism for an alternative exemplary embodiment of the invention having a mechanical advantage of 3:1.

An alternative exemplary embodiment of a work desk utilizes a gas spring operated mechanism with a 3:1 mechanical advantage and having the guide and support system previously described. As shown in FIG. 7, the gas spring operated mechanism 216 comprises a lockable gas spring 218 and pulley systems 220 and 221. A tube end 278 of gas spring 218 is inserted into a protective sleeve 282 and piston rod end 279 is attached to a support bracket 272. A bearing assembly 290 keeps the sleeve 282 and gas spring 218 on a true vertical axis so that no undue strain is put on either the outer tube 278 or piston rod end 279. Both the support bracket 272 and bearing assembly 290 are mounted on the rear wall of the base assembly (not shown). A crosspiece 222 is welded atop protective sleeve 282 and is used in the operation of pulley systems 220 and 221.

Pulley system 221 comprises pulleys 201 and 203 and cable 205. Pulley 201 is rotatably fastened to crosspiece 222 by a shoulder screw 209 and pulley 204 is rotatably fastened to a bracket 207 mounted on support bracket 272. Cable 205 has a eye end 210 and a lug end 216. Cable 205 is caught at eye end 210 on shoulder screw 209, passes downward, is trained around pulley 203, passes upward, is trained around pulley 201 and passes downward again where lug end 217 is attached to lift tab 116 on work surface assembly 14. Cable 206 similarly has an eye end caught on a shoulder screw, is trained around pulleys 202 and 204 and has a lug end 215 fastened to a lift tab 115.

If an operator decides to raise the work surface assembly 214, he or she depresses the foot operated lever which, through connecting rod 225, unlocks gas spring 218. The unlocked gas spring 218 expands, applying an upward force on protective sleeve 282, and consequently crosspiece 222, pulleys 201 and 202, and the eye ends of cables 205 and 206. As the pulleys 201 and 202 and eye ends of cables 205 and 206 rise, cables 205 and 206 exert a lifting force at their respectable lug ends 215 and 217 which raises the work surface assembly 214.

Since the mechanical advantages of a pulley system is equal to the number of strands supporting the system, the mechanical advantage of the pulley systems 220 and 221 is 3:1. Because the pulley systems 220 and 221 triple the distance moved by work surface 214, it is desirable that the gas spring 218 exert a force slightly exceeding three times the weight of the work surface assembly 214 and its normal contents. Then, the force transmitted to the work surface assembly 214 by the gas spring operated mechanism 216 is more than the weight of the work surface assembly 214 and its contents so that when gas spring 218 is unlocked the work surface assembly 214 will slowly rise or can easily be pushed downward. When the work surface assembly 214 is in its desired position the user releases the foot lever, again locking gas spring 218. The ball bearing slides and pulley support systems of the first embodiment are utilized, unchanged, in order to insure the smooth, nonjamming operation of work surface assembly 214.

What has been described is considered to be only two illustrative embodiments of the invention. For example, although the gas spring used in the disclosed embodiments of the invention is positioned so that the body of the gas spring moves upward during its operation while the piston rod is fixed to the base assembly, it is envisioned that the position of the gas spring be reversed. The piston rod end would be attached to the movable work surface assembly and the body of the gas spring would be attached to the fixed base assembly.

Further, gas spring operated systems are envisioned which have a mechanical advantage greater than 2:1 or 3:1 as herein disclosed. For example, by adding another pulley to the spring operated mechanism of the first embodiment, a four strand pulley system having a 4:1 mechanical advantage could be achieved.

It is also envisioned that the guide and support system of this invention could be used in conjunction with a force mechanism other than a gas spring. For example, an adjustable height work desk could be constructed with a spring counterbalanced mechanism that would provide the upward force to raise the working surface and also could utilize the ball bearing slide assemblies and cable support system of this invention. It is to be understood that various and numerous other arrangements may be devised by one skilled in the art without departing from the spirit and scope of the invention.

What is claimed is:

1. A work desk comprising a movable work surface assembly, a fixed base for supporting said movable assembly, and means for adjusting the height of said work surface assembly, comprising:

a bushing fixedly attached to said fixed base;

gas spring means for exerting a holding force and a driving force in the upward direction, comprising a cylinder section and a piston section, having one of said sections fixedly attached to said fixed base and the other section extending in a vertical direction through said bushing and slidingly engaged with said bushing; and pulley means for transmitting said driving force to said movable assembly, comprising a pulley attached to the other of said sections, and a cable wound over said pulley and having one end attached to a point on said movable assembly and extending vertically upward from said point and having another end attached to said one section of said gas spring means;

said gas spring means comprising locking means for cuasing said gas spring means to exert said holding force for holding said work surface assembly at its present height when locked, and for causing said gas spring means to exert said driving force when said locking means is unlocked.

2. A work desk comprising;

a movable work surface assembly;

a base assembly having two sides for supporting said movable assembly;

gas spring means for exerting a holding force and a driving force, having a movable part comprising a cylinder and fixed part comprising a piston, having said fixed part attached to said base assembly; and a first pulley system, for transmitting said driving force as an upward force to said movable assembly, comprising two members, said members mounted substantially symmetrically on each side of a vertical front-to-back center plane of said base assembly, each member of said first pulley system comprising one pulley attached to said movable part of said gas spring means and a cable wound over said pulley with one end attached to said movable assembly and extending vertically upward therefrom and one end attached to said fixed part of said gas spring means;

said gas spring means comprising locking means for causing said gas spring means to exert said holding force for holding said movable assembly at its present height when locked, and for causing said gas spring means to exert said driving force when said locking means is unlocked.

3. The work desk of claim 2, wherein said movable assembly has a left and a right side, said sides located on either side of said center plane, further comprising a second pulley system having two members, said members mounted substantially symmetrically on each side of said center plane, each member of said second pulley system comprising a pulley attached to said base assembly and a cable wound over said pulley, one end of said cable attached to one of the two sides of said work surface assembly.

4. The work desk of claim 3 further comprising two slides, said slides vertically mounted substantially symmetrically on each side of said center plane, each of said vertical slides comprising a movable section attached to one of said two sides of said work surface assembly and a fixed section attached to said base assembly.

5. The work desk of claim 2 further comprising two slides, said slides vertically mounted substantially symmetrically on each side of said center plane, each of said vertical slides comprising a movable section attached to one of said two sides of said work surface assembly and a fixed section attached to said base assembly.

6. A work desk comprising:

a vertically movable desk top assembly;

a fixed base comprising means for guiding vertical movement of said movable assembly;

a gas spring, comprising a cylinder section, a piston section, and a lock assembly having a lock and an unlock state, for exerting an upward force when said lock assembly is in the release state and for exerting a holding force when said lock assembly is in the lock state, said piston section fixedly attached to said base said cylinder section mounted vertically to pass through a bushing attached to said base, said gas spring mounted so that said cylinder section tends to move upward when said lock assembly is in the unlock state;

a first pulley attached to said cylinder section; and a first cable wound over and extending downward from both sides of said pulley, fixedly attached to said base assembly at one end and attached at the other end to said movable assembly at a point below said first pulley, extending upward on both ends;

whereby said movable assembly is urged upward when said lock assembly is in the unlock state and is held in position when said lock assembly is in the lock state.

7. The work desk of claim 6 further comprising a second pulley and a second cable, wherein said first pulley and cable and said second pulley and cable are mounted essentially symmetrically about a vertical front to back center plane of said base assembly.

8. The work desk of claim 7, wherein said movable assembly comprises two side sections and a back section, and said work desk further comprises a pair of auxiliary pulley systems the members of said pair of auxiliary pulley systems being mounted essentially symmetrically about said center plane, each member of said pair of auxiliary pulley systems comprising a series of pulleys, having a first pulley fixedly attached to said base assembly at a first point and having a second pulley fixedly attached to said base assembly at a second point, and a cable having two ends, one end of said cable being attached on said back section of said movable assembly at a third point located above said first point to exert a downward pull, the other end of said cable being attached on one of said side sections of said movable assembly at a fourth point located below said second point to exert an upward pull, said cable wound under said first of said series of pulleys to exert a downward pull on said back section of said movable assembly and wound over said second of said series of pulleys to exert an upward pull on said one of said side sections.

9. The work desk of claim 8 further comprising four slides for guiding the vertical movement of said movable assembly, mounted in pairs essentially symmetrically about said center plane each of said slides mounted vertically and having a fixed part attached to said base assembly and a movable part, slidingly engaged with said fixed part, attached to said movable assembly.

* * * * *